US012656089B1

(12) United States Patent
Hayes et al.

(10) Patent No.: US 12,656,089 B1
(45) Date of Patent: Jun. 16, 2026

(54) SHUNT CAP FOR SAFE DISCHARGE OF LOW-VOLTAGE DETONATORS

(71) Applicant: Kraken Kinetics Inc., West End, NC (US)

(72) Inventors: Ryan Austin Hayes, West End, NC (US); Brian Matthew Davis, Pinehurst, NC (US)

(73) Assignee: Kraken Kinetics Inc., West End, NC (US)

( * ) Notice: Subject to any disclaimer, the term of this patent is extended or adjusted under 35 U.S.C. 154(b) by 0 days.

(21) Appl. No.: 19/405,339

(22) Filed: Dec. 1, 2025

(51) Int. Cl.
*F42C 15/40* (2006.01)
*F42B 3/182* (2006.01)
*F42C 11/00* (2006.01)
*F42C 15/42* (2006.01)

(52) U.S. Cl.
CPC ..... *F42B 3/182* (2013.01); *F42C 11/00* (2013.01); *F42C 15/42* (2013.01)

(58) Field of Classification Search
CPC .. E21B 43/117; E21B 43/1185; E21B 43/119; E21B 43/116; E21B 43/112; E21B 17/028; E21B 34/063; E21B 34/10; F42D 1/05; F42B 3/182; F42C 15/34; F42C 11/00; F42C 15/42
See application file for complete search history.

(56) References Cited

U.S. PATENT DOCUMENTS 3,838,532 A * 10/1974 Prodanovich ..... F41B 11/83 102/371
3,978,791 A * 9/1976 Lemley ..... F42B 3/125 89/1.14
4,145,970 A * 3/1979 Hedberg ..... F42B 3/18 102/206
4,237,789 A * 12/1980 Stauers ..... F42C 17/04 102/270
5,101,727 A * 4/1992 Yarrington ..... F42B 3/113 102/201
6,389,976 B1 * 5/2002 Zacharin ..... F42C 15/21 102/254
6,484,617 B1 * 11/2002 Anderson ..... F42B 33/067 89/1.13
8,327,764 B2 * 12/2012 Trousselle ..... F42B 3/182 102/202.3
2004/0231547 A1 * 11/2004 Keil ..... F42C 15/44 102/206
2010/0005992 A1 * 1/2010 Crawford ..... F42C 15/34 102/202.1
2012/0210857 A1 * 8/2012 Paulic ..... F41C 9/06 89/5
2024/0418486 A1 * 12/2024 Dube ..... F42B 5/15

* cited by examiner

*Primary Examiner* — Michael D David
(74) *Attorney, Agent, or Firm* — Morrison & Foerster LLP

(57) ABSTRACT

A detonator device includes a voltage storage component; a first relay connected in series to an output of the voltage storage component; and detonation circuitry connected in series to an output of the first relay, the detonation circuitry comprising a detonator and a second relay connected in parallel to the detonator, wherein the output from the first relay is directed to ground via the second relay when the detonator device is in a first state, the output from the first relay is delivered to the detonator when the detonator device is in a second state, the detonator is configured to detonate when the output from the first relay is applied to the detonator in the second state, and the output from the first relay is between 5 and 100 volts.

15 Claims, 3 Drawing Sheets

SHUNT CAP FOR SAFE DISCHARGE OF LOW-VOLTAGE DETONATORS

FIELD

This disclosure relates generally to detonator architectures and more specifically to architecture for preventing unintended detonation of a low-voltage detonator.

BACKGROUND

Detonators provide an initial explosion that is used to trigger more powerful downstream explosives. Certain types of detonators require a high input voltage, e.g., greater than 500V, to deliver enough energy and trigger the initial explosion. For example, low-energy exploding foil initiators (LEEFIs) require approximately 900V to trigger the explosion of a foil, which creates a flyer plate with sufficient energy and shock to initiate a secondary explosive that is coupled to the initiator. A high voltage threshold for detonation prevents accidental detonation that could otherwise occur due to static discharge, electromagnetic interference (EMI), or other stray voltages that may be inadvertently applied to a detonator during storage or handling. However, detonators with high voltage thresholds can be expensive and difficult to manufacture, requiring specialty parts that can handle high voltages/energies reliably in an industrial/military setting. The manufacturing costs can prevent widespread usage and deployment of detonators with high voltage thresholds. A detonator with a lower voltage threshold for detonation can be cheaper and easier to make but is much more susceptible to accidental detonation, especially when the detonator is stored or utilized within close proximity of other active electronics, e.g., on an unmanned aerial vehicle. Accidental detonation poses a significant risk to any persons who are near to the explosives and prevents the explosives from being used for their intended purpose.

Accidental detonation of a low-voltage detonator can be prevented by ensuring voltage cannot be delivered to the detonator when the detonator is not in use. Typically, a detonator is manually shorted prior to use by twisting together the stripped or exposed ends of lead wires to create a short circuit while the detonator is not in use and until the very moment of system integration or explosive charge priming. The ends are then untwisted, enabling a connection to be made between the detonator and the device capable of detonating it. This process requires manual manipulation of the detonator wiring immediately prior to detonation, which is not possible when the detonator is triggered remotely, e.g., with an electronic safe and arm device (ESAD) that is configured to deliver a detonation voltage to the detonator. Remote detonation is increasingly common with the use of unmanned vehicles to carry explosives. Therefore, there is a need for an electronic system that can be used to detonate a low-voltage detonator remotely while also preventing accidental detonation by voltages that surpass the low-voltage detonation threshold.

SUMMARY

Disclosed herein are systems, devices, and methods that can be used to safely control a detonator by switching between a first state that prevents accidental detonation of the detonator and a second state that delivers voltage that is sufficient to detonate the detonator. In the first state, the detonator can be electrically isolated such that any current in the detonator system or device is diverted from the detonator, thus preventing unintended detonation. In the second state, the detonator can be electrically connected to a voltage source that is configured to deliver sufficient voltage and current to detonate the detonator. The detonator may be a low-voltage detonator where the voltage sufficient for detonation (a detonation threshold) may be, as a non-limiting example, between 0-24 volts. The detonation threshold may be, for example, approximately 1.5 volts, which is a relatively low voltage that may be present in a detonator device or system. In some embodiments, the voltage source may store the voltage while the system or device is in the first state such that the voltage can be rapidly delivered to the low-voltage detonator when the system or device transitions to the second state.

The disclosed systems, devices, and methods may include a shunt component that diverts current from the low-voltage detonator in the first state. The shunt component may be connected in parallel to the low-voltage detonator and may have a lower impedance than the impedance of the low-voltage detonator. The parallel shunt component creates an alternative and preferred path to ground for any static discharge, EMI, or stray voltage that is present at the shared node between the shunt component and the low-voltage detonator. As a result, any current that flows to the shared node will be diverted to ground through the shunt component rather than through the low-voltage detonator, thereby preventing unintended detonation of the low-voltage detonator. In the second state, the shunt component may be deactivated so that current can flow through the low-voltage detonator to apply the detonation voltage to the low-voltage detonator.

The disclosed systems, devices, and methods may include one or more switching mechanisms to switch between the first state and the second state. In some embodiments, the disclosed systems, devices, and methods may include a first switch that controls current flow between the voltage storage and the low-voltage detonator and a second switch that controls current flow to the branch that is parallel to the low-voltage detonator. The two switches may be controlled electronically to remotely transition the detonator system or device between the first state and the second state for precise firing control. The two switches provide two independent ways of preventing voltage from being applied to the low-voltage detonator, thus increasing the robustness of the safety mechanism. For example, even if one switch fails, the other switch still prevents voltage from the voltage source from reaching the low-voltage detonator. The disclosed systems, devices, and methods therefore enable safe and precise remote detonation of low-voltage detonators that are prone to accidental detonation. The disclosed systems, devices, and methods may be integrated into ESADs and existing blasting cap designs without requiring specialized safety protocols or high-voltage components. A detonator device or system that does not require specialized high-voltage components can be manufactured more cheaply and with more commonly accessible electronic components, thereby enabling increased production and adoption of the detonator device or system.

According to some embodiments, an exemplary detonator device comprises a voltage storage component; a first relay connected in series to an output of the voltage storage component; and detonation circuitry connected in series to an output of the first relay, the detonation circuitry comprising a detonator and a second relay connected in parallel to the detonator, wherein the output from the first relay is directed to ground via the second relay when the detonator device is in a first state, the output from the first relay is delivered to the detonator when the detonator device is in a second state, the detonator is configured to detonate when the output from the first relay is applied to the detonator in the second state, and the output from the first relay is between 5 and 100 volts.

Optionally, the output from the first relay is approximately 12 volts.

Optionally, the first relay is open and the second relay is closed when the detonator device is in the first state.

Optionally, the first relay is closed and the second relay is open in the second state.

Optionally, the first relay and/or the second relay comprises an electromechanical relay.

Optionally, the first relay and/or the second relay comprises a solid state relay.

Optionally, the first relay is a naturally open relay and the second relay is a naturally closed relay.

Optionally, the first relay is configured to switch between an open state and a closed state based on an electronic control signal.

Optionally, the second relay is configured to switch between a closed state and an open state based on an electronic control signal.

Optionally, the first relay and the second relay are configured to switch between respective states based on a shared electronic control signal.

Optionally, the detonator device further comprises one or more processors and memory storing one or more programs, the one or more programs configured to be executed by the one or more processors.

Optionally, the one or more programs include instructions that when executed cause the one or more processors to transmit an electronic control signal to the first relay to change a state of the first relay.

Optionally, the one or more programs include instructions that when executed cause the one or more processors to transmit an electronic control signal to the second relay to change a state of the second relay.

Optionally, the detonator device further comprises voltage sensing circuitry configured to determine a relay voltage at an output of the first relay and transmit the relay voltage to the one or more processors.

Optionally, the one or more programs include instructions that when executed cause the one or more processors to transmit an electronic control signal to the first relay based on the relay voltage.

Optionally, the detonator device further comprises voltage sensing circuitry configured to determine a relay voltage at an output of the second relay and transmit the relay voltage to the one or more processors.

Optionally, the one or more programs include instructions that when executed cause the one or more processors to transmit an electronic control signal to the second relay based on the relay voltage.

Optionally, the detonator device further comprises an explosive coupled to the detonator.

According to some embodiments, an exemplary method of arming a detonator device comprises storing the detonator device in a pre-armed state, wherein the detonator device comprises a voltage storage component that is uncharged in the pre-armed state and a detonator; and arming the detonator device by charging the voltage storage component to a voltage sufficient to detonate the detonator, wherein an output of the voltage storage component is connected in series to a first relay, an output of the first relay is connected to a parallel combination of the detonator and a second relay, the output of the voltage storage component is directed to ground via the second relay when the detonator device is in the pre-armed state and when the detonator device is armed, and the voltage sufficient to detonate the detonator is between 5 and 100 volts.

Optionally, the method further comprises detonating the detonator device by opening the second relay and closing the first relay such that the output of the first relay is delivered to the detonator.

BRIEF DESCRIPTION OF THE FIGURES

A better understanding of the features and advantages of the present disclosure will be obtained by reference to the following detailed description that sets forth illustrative embodiments, in which the principles of the disclosure are utilized, and the accompanying drawings of which.

DETAILED DESCRIPTION

The present disclosure is directed to a detonator system or device comprising circuitry configured to control current flow between a voltage source and a detonator. The circuitry may be configured for a plurality of states including at least a first state where the detonator does not receive current flow and a second state where the detonator receives current and voltage from the voltage source for detonation. The circuitry may include one or more switches that open and close electrical connections between circuit components, wherein the state of the detonator device or system is based on the state of the one or more switches. The switches may be electromechanical switches (e.g., electromechanical relays) or electrical switches (e.g., solid state relays, diodes, transistors). In some embodiments, the disclosed systems and devices may include one or more processors configured to control the state of the one or more switches.

In the following description of the various embodiments, it is to be understood that the singular forms "a," "an," and "the" used in the following description are intended to include the plural forms as well, unless the context clearly indicates otherwise. It is also to be understood that the term "and/or" as used herein refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units but do not preclude the presence or addition of one or more other features, integers, steps, operations, elements, components, units, and/or groups thereof.

Figure 1:
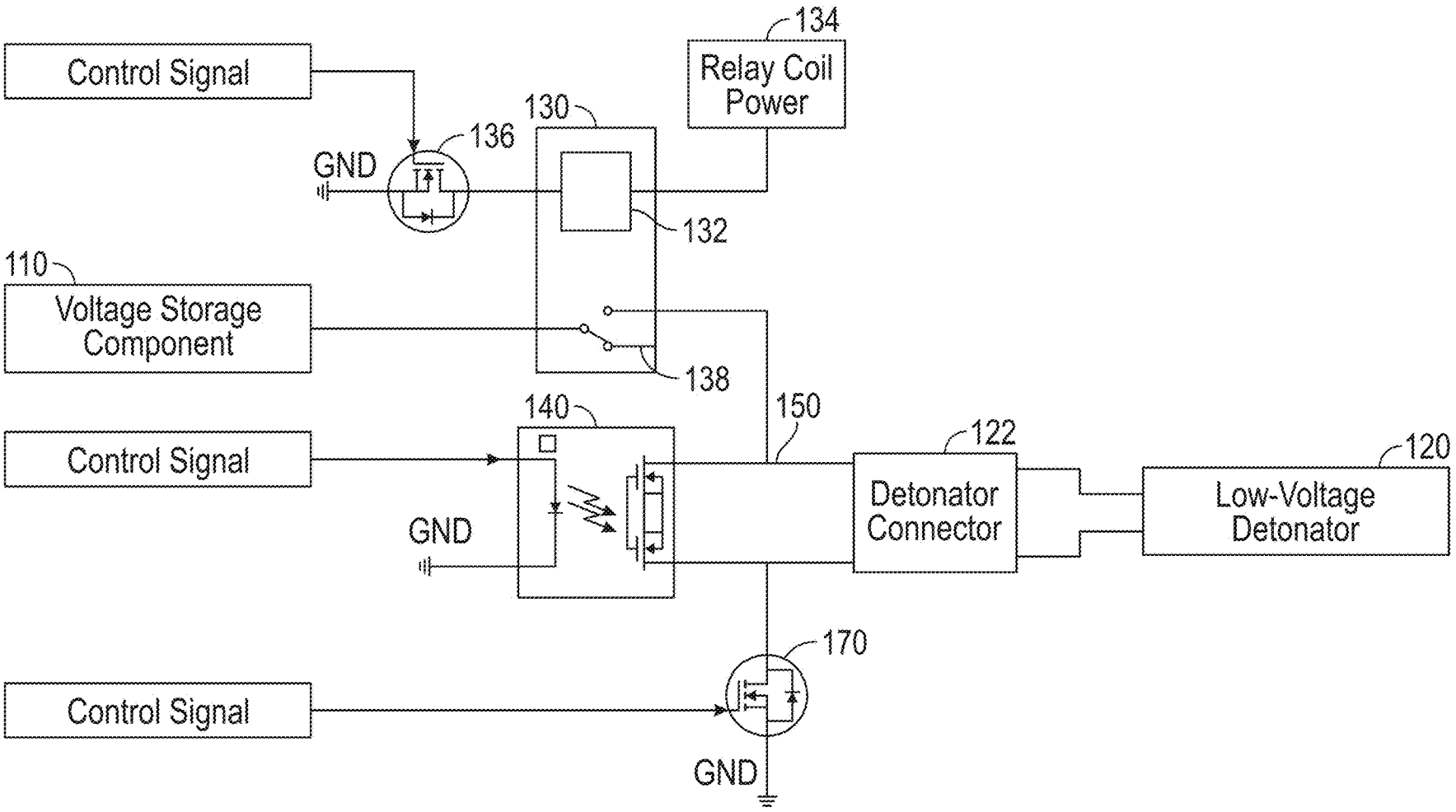
FIG. 1 illustrates detonator circuitry according to some embodiments.

FIG. 1 is a schematic of detonator circuitry 100 in a detonator system or device according to some embodiments. The circuitry includes a voltage storage component 110 and a detonator 120. The voltage storage component 110 is configured to store a voltage that is sufficient to detonate the detonator 120. In some embodiments, the detonator 120 may be a low-voltage detonator. In some embodiments, the voltage needed to detonate a low-voltage detonator (a detonation threshold) may be up to 1 volt, up to 2 volts, up to 3 volts, up to 4 volts, up to 5 volts, up to 6 volts, up to 7 volts, up to 8 volts, up to 9 volts, up to 10 volts, up to 11 volts, up to 12 volts, up to 13 volts, up to 14 volts, up to 15 volts, up to 16 volts, up to 17 volts, up to 18 volts, up to 19 volts, up to 20 volts, up to 21 volts, up to 22 volts, up to 23 volts, up to 24 volts, up to 25 volts, up to 26 volts, up to 27 volts, up to 28 volts, up to 29 volts, up to 30 volts, up to 31 volts, up to 32 volts, up to 33 volts, up to 34 volts, up to 35 volts, up to 36 volts, up to 37 volts, up to 38 volts, up to 39 volts, up to 40 volts, up to 41 volts, up to 42 volts, up to 43 volts, up to 44 volts, up to 45 volts, up to 46 volts, up to 47 volts, up to 48 volts, up to 49 volts, up to 50 volts, or up to greater than 50 volts, e.g., between 50-100 volts. In some embodiments, the detonation threshold may be at least 1 volt, at least 2 volts, at least 3 volts, at least 4 volts, at least 5 volts, at least 6 volts, at least 7 volts, at least 8 volts, at least 9 volts, at least 10 volts, at least 11 volts, at least 12 volts, at least 13 volts, at least 14 volts, at least 15 volts, at least 16 volts, at least 17 volts, at least 18 volts, at least 19 volts, at least 20 volts, at least 21 volts, at least 22 volts, at least 23 volts, at least 24 volts, at least 25 volts, at least 26 volts, at least 27 volts, at least 28 volts, at least 29 volts, at least 30 volts, at least 31 volts, at least 32 volts, at least 33 volts, at least 34 volts, at least 35 volts, at least 36 volts, at least 37 volts, at least 38 volts, at least 39 volts, at least 40 volts, at least 41 volts, at least 42 volts, at least 42 volts, at least 43 volts, at least 44 volts, at least 45 volts, at least 46 volts, at least 47 volts, at least 48 volts, at least 49 volts, at least 50 volts, or at least greater than 50 volts, e.g., between 50-100 volts. In some embodiments, the detonation threshold may be between 0-50 volts, between 3-50 volts, between 5-50 volts, between 9-50 volts, between 12-50 volts, between 15-50 volts, between 18-50 volts, between 21-50 volts, between 24-50 volts, between 27-50 volts, between 30-50 volts, between 33-50 volts, between 36-50 volts, between 39-50 volts, between 42-50 volts, between 45-50 volts, or between 48-50 volts. In some embodiments, the detonation threshold may be between 0-50 volts, 0-48 volts, between 0-45 volts, between 0-42 volts, between 0-39 volts, between 0-36 volts, between 0-33 volts, between 0-30 volts, between 0-27 volts, between 0-24 volts, between 0-21 volts, between 0-18 volts, between 0-15 volts, between 0-12 volts, between 0-9 volts, between 0-5 volts, or between 0-3 volts. In some embodiments, the detonation threshold may be approximately 1.8 volts, 3.3 volts, 5 volts, 12 volts, 24, or 48 volts. In some embodiments, the detonation threshold may be between 0-100 volts, between 5-100 volts, between 10-100 volts, between 20-100 volts, between 30-100 volts, between 40-100 volts, between 50-100 volts, between 60-100 volts, between 70-100 volts, between 80-100 volts, between 90-100 volts. Electrically isolating the detonator 120 is especially important given the low detonation threshold.

The detonation threshold of a detonator may also be defined as an energy threshold. The energy threshold may be an all-fire energy in joules that must be delivered to the detonator to trigger detonation. The energy may be delivered as a pulse from the voltage storage component 110 having a certain voltage, current, and duration that satisfies the energy threshold. In some embodiments, the duration of the pulse may be less than 100 nanoseconds (ns), between 100 ns to 1 millisecond (ms), between 1 ms to 100 ms, or greater than 100 ms.

The energy threshold for a low-voltage detonator as described herein may be up to 1 mJ, up to 2 mJ, up to 3 mJ, up to 4 mJ, up to 5 mJ, up to 6 mJ, up to 7 mJ, up to 8 mJ, up to 9 mJ, up to 10 mJ, up to 11 mJ, up to 12 mJ, up to 13 mJ, up to 14 mJ, up to 15 mJ, up to 16 mJ, up to 17 mJ, up to 18 mJ, up to 19 mJ, up to 20 mJ, up to 21 mJ, up to 22 mJ, up to 23 mJ, up to 24 mJ, up to 25 mJ, up to 26 mJ, up to 27 mJ, up to 28 mJ, up to 29 mJ, up to 30 mJ, up to 31 mJ, up to 32 mJ, up to 33 mJ, up to 34 mJ, up to 35 mJ, up to 36 mJ, up to 37 mJ, up to 38 mJ, up to 39 mJ, up to 40 mJ, or up to greater than 40 mJ. In some embodiments, the energy threshold may be at least 1 mJ, at least 2 mJ, at least 3 mJ, at least 4 mJ, at least 5 mJ, at least 6 mJ, at least 7 mJ, at least 8 mJ, at least 9 mJ, at least 10 mJ, at least 11 mJ, at least 12 mJ, at least 13 mJ, at least 14 mJ, at least 15 mJ, at least 16 mJ, at least 17 mJ, at least 18 mJ, at least 19 mJ, at least 20 mJ, at least 21 mJ, at least 22 mJ, at least 23 mJ, at least 24 mJ, at least 25 mJ, at least 26 mJ, at least 27 mJ, at least 28 mJ, at least 29 mJ, at least 30 mJ, at least 31 mJ, at least 32 mJ, at least 33 mJ, at least 34 mJ, at least 35 mJ, at least 36 mJ, at least 37 mJ, at least 38 mJ, at least 39 mJ, at least 40 mJ, or at least greater than 40 mJ. In some embodiments, the energy threshold may be between 0-40 mJ, between 0-30 mJ, between 0-20 mJ, between 0-15 mJ, between 0-10 mJ, between 0-5 mJ, between 5-40 mJ, between 10-40 mJ, between 15-40 mJ, between 20-40 mJ, between 30-40 mJ, between 5-20 mJ, or between 5-30 mJ.

The current of the pulse may be sufficient to deliver energy based on the voltage stored in the voltage storage component 110 and the duration of the energy pulse. For example, the current may be up to 1 amp, up to 2 amps, up to 3 amps, up to 4 amps, up to 5 amps, up to 6 amps, up to 7 amps, up to 8 amps, up to 9 amps, up to 10 amps, up to 11 amps, up to 12 amps, up to 13 amps, up to 14 amps, up to 15 amps, up to 16 amps, up to 17 amps, up to 18 amps, up to 19 amps, up to 20 amps or greater than 20 amps, e.g., between 20-40 amps. In some embodiments, the current may be at least 1 amp, at least 2 amps, at least 3 amps, at least 4 amps, at least 5 amps, at least 6 amps, at least 7 amps, at least 8 amps, at least 9 amps, at least 10 amps, at least 12 amps, at least 13 amps, at least 14 amps, at least 15 amps, at least 16 amps, at least 17 amps, at least 18 amps, at least 19 amps, at least 20 amps, or at least between 20-40 amps. In some embodiments, the current delivered to the detonator may be between 1-40 amps, between 1-35 amps, between 1-30 amps, between 1-25 amps, between 1-20 amps, between 1-15 amps, between 1-10 amps, between 1-5 amps, between 5-40 amps, between 10-40 amps, between 15-40 amps, between 20-40 amps, between 25-40 amps, between 30-40 amps, or between 35-40 amps.

The detonation threshold may be approximately the same as or less than a rail voltage used by the detonator device or system and/or other devices or systems that are connected thereto, which means that the low-voltage detonator is susceptible to accidental detonation by voltages that are commonly present throughout the detonator device or system. For example, a component failure or unintended short in the circuitry can deliver a sufficient voltage for detonation to the node 150 that is connected to the first lead of the detonator 120. The rail voltage may be the voltage supplied to the detonator device or system by a power supply. The rail voltage may be the voltage of a digital HIGH signal. In some embodiments, the rail voltage of the detonator device or system may be up to 1 volt, up to 1.8 volts, up to 3.3 volts, up to 5 volts, up to 9 volts, up to 12 volts, up to 24 volts, up to 48 volts, or greater than 48 volts, e.g., between 50-100 volts. In some embodiments, the rail voltage of the detonator device or system may be at least 1 volt, at least 1.8 volts, at least 3.3 volts, at least 5 volts, at least 9 volts, at least 12 volts, at least 24 volts, or at least 48 volts. In some embodiments, the rail voltage may be between 0-48 volts, between 3-48 volts, between 5-48 volts, between 9-48 volts, between 12-48 volts, between 15-48 volts, between 18-48 volts, between 21-48 volts, or between 24-48 volts. In some embodiments, the rail voltage may be between 0-21 volts, between 0-18 volts, between 0-15 volts, between 0-12 volts, between 0-9 volts, between 0-5 volts, or between 0-3 volts.

The voltage storage component 110 may include one or more capacitors (e.g., a capacitor bank) or a battery. In some embodiments, the voltage storage component 110 may include a voltage amplifier such as an operational amplifier. The detonator 120 may be connected to the circuitry via a detonator connector 122. The detonator connector 122 may be, for example, a two-pin connector with a male and female pin. In some embodiments, the detonator 120 may be external to the other components in the detonator circuitry. For example, the components of the detonator circuitry other than the detonator 120 may be contained in an ESAD. The ESAD may also comprise one or more processors, e.g., a microcontroller (MCU), and memory. The ESAD may include a housing that contains the internal components. The ESAD may be connected to the detonator 120 via the detonator connector 122, and the detonator connector 122 may deliver the voltage to the connected detonator 120. The detonator 120 may be, for example, a blasting cap such as the M6 blasting cap, MK 18/20 blasting cap, electric matches, squibs/electric squibs, pyrotechnic or training devices, etc. The detonator 120 may be coupled to one or more downstream explosives.

The voltage storage component 110 may be electrically connected to a first switch in series such that the output of the voltage storage component 110 is the input to the first switch. In some embodiments, the first switch may be a relay 130 as illustrated in FIG. 1. In some embodiments, the first relay 130 may be an electromechanical relay as illustrated in FIG. 1, which uses an electromagnetic coil 132 to create a magnetic field that changes the position of a switch in the relay in order to open or close electrical connections between the input and the output of the relay. The first relay 130 may be connected to a relay power source 134 that provides power to the electromagnetic coil 132. The electromagnetic coil 132 may be grounded via a switch. The switch may be a transistor, e.g., a first MOSFET 136 as illustrated in FIG. 1. When a voltage less than the MOSFET threshold voltage (e.g., no voltage) is applied to the MOSFET gate, the first MOSFET 136 is off and current does not flow from the relay power source 134 to ground, resulting in the first relay 130 being in its default state. When a voltage greater than the MOSFET threshold voltage is applied to the MOSFET gate, the first MOSFET 136 is turned on and current may flow from the relay power source 134 to ground. The current energizes the electromagnetic coil 132 to change the position of the switch 138 in the relay. Thus, the state of the first relay 130 may be changed by applying a voltage to the gate of the MOSFET 136.

In some embodiments, the first relay 130 may be a solid state relay, which controls a photo-sensitive transistor using optical coupling between a light source and the photo-sensitive transistor. The photo-sensitive transistor functions as a switch to open or close an electrical connection between the input and the output of the relay in response to the light source. When no current flows through the light source, the photo-sensitive transistor is in its default state. When a current flows through the light source (e.g., a diode), the photo-sensitive transistor senses the light from the diode and changes state.

A naturally open relay maintains an open circuit by default such that the input and the output of the relay are not connected unless sufficient voltage is applied to a switching element of the relay, e.g., a transistor (for an electromechanical relay) or the light source (for a solid state relay). The output of the relay may be connected to ground in the open state rather than the input of the relay. A naturally closed relay maintains a closed circuit by default such that the input and output of the relay are connected unless sufficient voltage is applied to the switching element of the relay. In some embodiments, the first relay 130 may be a naturally open relay such that the input (the voltage from the voltage storage component) and the output of the relay are not connected in the default position until a voltage is applied to the gate of the first MOSFET 136. When the first relay 130 is open, the voltage storage component 110 may be disconnected from the rest of the circuitry. When the first relay 130 is closed, the voltage storage component 110 may be connected to the rest of the circuitry and the voltage stored by the voltage storage component 110 may be discharged through the rest of the circuitry. In other embodiments, the first relay 130 may be a naturally closed relay.

The output of the first switch may be connected in series to detonation circuitry comprising a parallel combination of the detonator 120 and a second switch. The second switch may be a second relay 140 as illustrated in FIG. 1. The second relay 140 may be an electromechanical relay or a solid state relay. The input to the second relay 140 and a first lead of the detonator 120 may be a shared node 150, which is the output of the first relay 130. Accordingly, the second relay 140 creates a path from the shared node 150 to ground in the closed position and an open circuit in the open position. In some embodiments, the branch comprising the second relay 140 may include one or more additional electrical components. In other embodiments, the second relay 140 may be the only component in its branch, as illustrated in FIG. 1. The impedance of the branch comprising the second relay 140 when the second relay 140 may be lower than the impedance of the branch comprising the detonator 120 when the second relay 140 is in a closed state. As a result, when the second relay 140 is in a closed state, the majority of the current at the shared node 150 flows to ground through the second relay 140 rather than through the detonator 120. The second relay 140 therefore diverts current from the detonator 120 when the second relay 140 is in the closed position. When the second relay 140 is in an open position, the current at the shared node 150 flows through the detonator 120 because the branch containing the second relay 140 is an open circuit (infinite impedance).

In some embodiments, the second relay 140 may be a naturally closed relay and may create a path to ground unless a voltage is applied to the switching element of the second relay 140. In other embodiments, the second relay 140 may be a naturally open relay. In some embodiments, the first relay 130 and the second relay 140 may have opposite default positions. For example, the first relay 130 may be naturally open while the second relay 140 may be naturally closed, resulting in less voltage/current draw when the detonator is not being detonated (e.g., during storage, handling, and transport).

In some embodiments, the detonator circuitry 100 may include a switch (e.g., a relay, a transistor) in series with the detonator connector 122 to control current flow to the detonator connector 122. An open switch in series with the detonator connector 122 prevents current flow to the branch containing the detonator connector 122, while a closed switch allows current flow to the branch containing the detonator connector 122. The position of the switch may be controlled by the one or more processors of the detonator system or device.

In some embodiments, the detonator circuitry 100 may include a third switch between ground and the parallel combination of the second switch and the low voltage detonator. The third switch may be, for example, a low-side transistor such as the second MOSFET 170 illustrated in FIG. 1. The transistor may connect the circuit load to ground and allow current to flow through the circuit in an on state. When the transistor is turned off, the circuit as a whole is open, and current may not flow through the circuit so that power cannot be delivered to the detonator. In some embodiments, the transistor may be controlled by an electronic control signal from the one or more processors. In some embodiments, the electronic control signal may default to a voltage that is below the threshold voltage of the transistor. The transistor may be off and may prevent current from flowing through the circuit until the electronic control signal changes to a voltage that is greater than the threshold voltage of the transistor. Thus, the transistor may function as an additional safety mechanism to rapidly switch the circuit on and off with a single electronic control signal.

The positions of the first switch (e.g., the first relay 130) and/or the second switch (e.g., the second relay 140) may be set to control current flow through the detonator circuitry 100. The detonator device or system may be configured in a first state where current does not flow from the voltage storage component 110 to the detonator 120 and a second state where current flows from the voltage storage component 110 to the detonator 120. In the first state, the voltage storage component 110 may be disconnected from the downstream components in the circuitry by the first relay 130. For example, the first relay 130 may be open such that there is an open circuit between the voltage storage component 110 and the circuitry at the output of the first relay 130. The second relay 140 may be closed to form a low-impedance path to ground (a shunt) that is parallel to the detonator 120. Thus, the voltage storage component 110 and the low-voltage detonator remain isolated from each other even if one of the switches fails or changes position in the first state. For example, if the first relay 130 closes, the voltage from the voltage storage component 110 may be discharged to the shared node 150. However, the second relay 140 in a closed position diverts the current at the shared node 150 to ground, preventing the voltage from reaching the detonator 120 and causing accidental detonation. Similarly, if any static discharge, EMI, or other voltage source creates stray voltage at the shared node 150, the stray voltage will be diverted through the second relay 140 in the closed position rather than being delivered to the detonator 120. This safety mechanism is especially important given that a relatively low stray voltage (e.g., between 0-24 volts) would be sufficient to detonate a low-voltage detonator. If the second relay 140 opens, the stored voltage will remain in the voltage storage component 110 because the first relay 130 maintains an open circuit between the voltage storage component 110 and the downstream components. Thus, the detonator 120 remains protected from accidental detonation by the combination of switches.

In some embodiments, the first state of the detonator device or system may comprise a pre-armed state and an armed state. The pre-armed state may be an initial state of the detonator device or system where the voltage storage component 110 does not store a voltage for detonating the detonator. For example, the voltage storage component 110 may include capacitors that have not yet charged in the pre-armed state. In some embodiments, the voltage storage component 110 may be disconnected from a voltage source in the pre-armed state.

In the armed state, the voltage storage component 110 may store a voltage. Arming the voltage storage component 110 may include connecting the voltage storage component 110 to a voltage source. As an example, the voltage storage component 110 may include a capacitor bank that is connected to a voltage source. The capacitor bank may store the voltage for detonating a low-voltage detonator in the armed state. The stored voltage may meet the detonation threshold for a low-voltage detonator. The stored voltage may be, for example, up to 1 volt, up to 2 volts, up to 3 volts, up to 4 volts, up to 5 volts, up to 6 volts, up to 7 volts, up to 8 volts, up to 9 volts, up to 10 volts, up to 11 volts, up to 12 volts, up to 13 volts, up to 14 volts, up to 15 volts, up to 16 volts, up to 17 volts, up to 18 volts, up to 19 volts, up to 20 volts, up to 21 volts, up to 22 volts, up to 23 volts, up to 24 volts, or greater than 24 volts, e.g., between 24-50 volts. In some embodiments, the stored voltage may be at least 1 volt, at least 2 volts, at least 3 volts, at least 4 volts, at least 5 volts, at least 6 volts, at least 7 volts, at least 8 volts, at least 9 volts, at least 10 volts, at least 11 volts, at least 12 volts, at least 13 volts, at least 14 volts, at least 15 volts, at least 16 volts, at least 17 volts, at least 18 volts, at least 19 volts, at least 20 volts, at least 21 volts, at least 22 volts, at least 23 volts, at least 24 volts, or greater than 24 volts, e.g., between 24-50 volts. In some embodiments, the stored voltage may be between 0-24 volts, between 3-24 volts, between 5-24 volts, between 9-24 volts, between 12-24 volts, between 15-24 volts, between 18-24 volts, or between 21-24 volts. In some embodiments, the stored voltage may be between 0-21 volts, between 0-18 volts, between 0-15 volts, between 0-12 volts, between 0-9 volts, between 0-5 volts, or between 0-3 volts. In some embodiments, the stored voltage may be approximately 1.8 volts, 3.3 volts, 5 volts, 12 volts, or 24 volts. A voltage that meets the detonation threshold for a low-voltage detonator can be stored without requiring specialized high-voltage components, resulting in cheaper and more compact detonation circuitry.

In some embodiments, the detonator device or system may include one or more processors configured to execute an arming protocol to charge the voltage storage component 110 and transition from the pre-armed state to the armed state. The arming protocol may include one or more interlock checks and/or conditions that must be satisfied before the voltage storage component 110 is charged. As an example, the arming protocol may include determining a state of one or more switches in the circuitry, setting a state of one or more switches in the circuitry, delivering power to one or more components in the circuitry, and/or terminating power to one or more components in the circuitry. Examples of conditions in the arming protocol may include whether the detonator device has been launched, environmental conditions, whether a certain amount of time has elapsed based on hardware or software timers, time windowing and sequencing of a power application, and receiving one or more commands or instructions. The arming protocol may ensure that the detonator is electrically isolated and will not be accidentally detonated when the voltage storage component 110 is charged. In some embodiments, the arming protocol may initiate the armed state by electrically connecting the voltage storage component 110 to a voltage source. As an example, the detonator device or system may include a switch between the voltage storage component 110 and a voltage source. The detonator device or system may close the switch after the checks and/or conditions are satisfied so that the voltage storage component 110 can begin charging. The detonator device or system may stay in the armed state until detonation. The armed voltage storage component 110 can be immediately discharged to deliver the stored voltage to the detonator, thus enabling precise control over the timing of detonation.

In the second state, the voltage storage component 110 and the detonator 120 may be electrically connected such that the stored voltage from the voltage storage component 110 can be delivered to the detonator 120. In some embodiments, the detonator device or system may be in the second state when the first switch is closed and the second switch is open. For example, the first relay 130 may be closed and the second relay 140 may be open. In the second state, the stored voltage from the voltage storage component 110 may flow through the first relay 130 to the shared node 150 between the second relay 140 and the detonator 120. The open second relay 140 creates an open circuit in the branch that is parallel to the detonator 120; thus, current at the shared node 150 can only flow through the detonator 120. The stored voltage from the voltage storage component 110 at node 150 is therefore delivered to the detonator 120, causing detonation.

In some embodiments, the detonator device or system may transition from the first state to the second state using a detonation protocol that includes transmitting electronic control signals to the first switch (e.g., the first relay 130) and to the second switch (e.g., the second relay 140). The electronic control signals may close the first relay 130 and open the second relay 140. In some embodiments, the one or more processors may transmit a first signal to open the second relay 140 followed by a second signal to close the first relay 130. The sequential signals ensure that the voltage from the voltage storage component 110 can only be delivered to the detonator 120 rather than to the second relay 140 once the first relay 130 is closed. In some embodiments, the one or more processors may include a delay between transmission of the first signal to open the second relay 140 and the second signal to close the first relay 130. In some embodiments, the one or more processors may transmit a shared electronic control signal to open the second relay 140 and close the first relay 130. For example, in embodiments where the first relay 130 is a naturally open relay and the second relay 140 is a naturally closed relay, a single electronic control signal (e.g., a digital HIGH signal) can close the first relay 130 and open the second relay 140. In some embodiments, the second relay 140 may change states quicker than the first relay 130. For example, the second relay 140 may be a solid state relay and the first relay 130 is an electromechanical relay as illustrated in FIG. 1, where solid state relays change states quicker than electromechanical relays. In some embodiments, an electronic control signal may be transformed prior to being delivered to the first relay 130 or the second relay 140. The transformation may include amplifying, inverting, or filtering the signal.

In some embodiments, the detonator device or system may include one or more sensors configured to measure a voltage or a current at a node in the detonator circuitry 100. The sensor data from the one or more sensors may be used to determine a state of the detonator device or system, a state of a switching mechanism in the detonator device or system, or a voltage or current through an element in the circuitry. The one or more sensors may transmit sensor data to the one or more processors of the detonator device or system. As an example, the detonator device or system may include a first voltage sensor configured to measure the voltage across the leads (input and output) of the first relay 130 and a second voltage sensor configured to measure the voltage across the leads of the second relay 140. When the detonator device or system is in the first state, the voltage across the leads of the first relay 130 should be approximately zero because the first relay 130 is in an open state. The voltage across the leads of the second relay 140 should also be approximately zero but may be greater than zero if there is stray voltage in the circuit. When the detonator device or system is in the second state, the voltage across the leads of the first relay 130 should be approximately the voltage stored in the voltage storage component 110 and the voltage across the leads of the second relay 140 should be approximately zero. As another example, the detonator device or system may include a voltage sensor configured to measure the voltage across the leads of the detonator 120. The voltage across the leads of the detonator 120 should be approximately zero when the detonator device or system is in the first state. As another example, the detonator device or system may include a voltage sensor configured to measure the voltage stored in the voltage storage component 110. In some embodiments, the sensors may be configured to measure current in line with the components (first relay 130, second relay 140, detonator 120, etc.).

In some embodiments, the detonator device or system may control the circuitry based on sensor data from the one or more sensors. One or more processors in the detonator device or system may receive sensor data from one or more sensors at regular intervals or may poll one or more sensors for sensor data at certain times. For example, in the pre-armed state, the detonator device or system may determine the voltage across the first relay 130 and the voltage across the second relay 140 to confirm that the voltage storage component 110 is electrically isolated from the detonator 120. In some embodiments, the detonator device or system may compare the voltage readings from the one or more sensors to a threshold to determine the state of the circuitry. If the voltage across the first relay 130 is below the threshold value, the detonator device or system may then execute the arming protocol to transition to the armed state by charging the voltage storage component 110 with the voltage needed to detonate the low-voltage detonator.

As another example, the detonator device or system may interrupt an arming or detonation protocol based on sensor data from the one or more sensors. The protocol may include determining a voltage across the first relay 130 or a voltage at node 150 prior to opening the second relay 140. In some embodiments, the voltage across the first relay 130 and/or at node 150 should be approximately zero prior to arming or detonation because the first relay 130 is still open and there is no current flow from the voltage storage component 110. A voltage across the first relay 130 and/or at the node 150 may indicate a malfunction in the circuit, e.g., that the first relay 130 is closed or that there is stray voltage in the circuit. The detonator device or system may interrupt the arming or detonation protocol in response to detecting voltage across the first relay 130 and/or at the node 150 prior to closing the first relay 130. In some embodiments, the detonator device or system may revert to the first state where the voltage storage component 110 and the detonator 120 are electrically isolated from each other in response to data from the one or more sensors that indicates there is a failure or issue with the circuitry. In some embodiments, the detonator device or system may control the second MOSFET 170 based on data from the one or more sensors. For example, data from the one or more sensors may indicate that the voltage or current across a component in the circuitry is greater than a safety threshold, e.g., 12 volts or 1 amp. The detonator device or system may turn off the second MOSFET 170 to create an open circuit and stop current flow in the circuitry. In some embodiments, the detonator device or system may drain the voltage from the voltage storage component 110 when the sensor data indicates that there is a failure or issue with the circuitry. For example, the detonator device or system may disconnect the voltage storage component 110 from a voltage source and connect the voltage storage component 110 to ground so that the voltage storage component 110 discharges its stored voltage. In some embodiments, the detonator device or system may interrupt an arming or detonation protocol, discharge the voltage storage component 110, or revert to the first state in response to an instruction received by the detonator device or system.

In some embodiments, the detonator device or system may generate an alert based on the data from the one or more sensors. The alert may include a visual alert, an audio alert, or a haptic feedback alert indicating that there is a failure or other issue with the circuitry. In some embodiments, the detonator device or system may transmit the alert to a remote device that is being used to control the detonator device. The alert may include information such as the sensor data, the location of the sensor, a component in the circuit that may be the cause of the issue, or a component in the circuit that may be affected by the issue.

Figure 2:
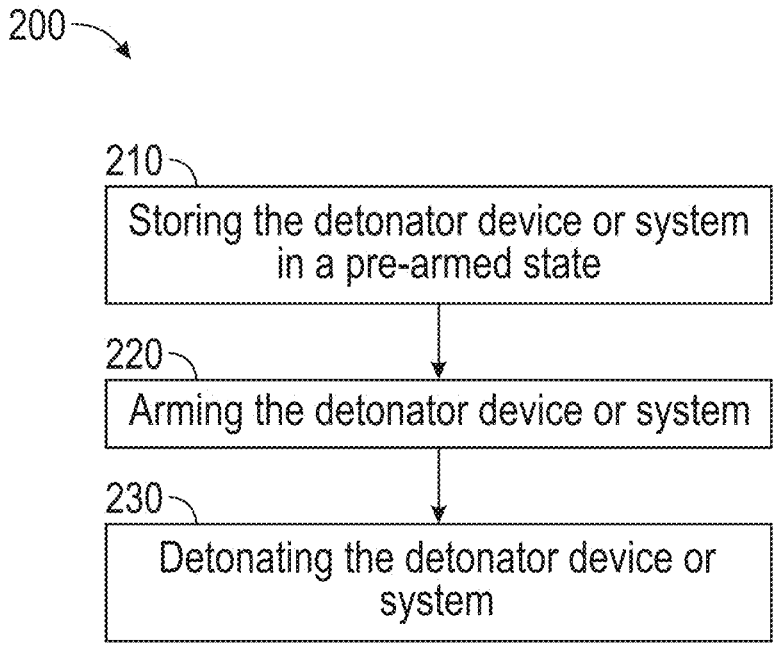
FIG. 2 illustrates a method of arming a detonator device or system according to some embodiments.

FIG. 2 illustrates a method 200 of arming the detonator device or system according to some embodiments. At step 210, the detonator device or system may be stored in a pre-armed state. In an example implementation, the detonator device or system may be mounted to a delivery device that is configured to deliver the detonator device to a detonation site for storage. The delivery device may be, for example, an unmanned aerial vehicle such as a drone. In the pre-armed state, the detonator circuitry may be connected to the detonator. The voltage storage component may be uncharged in the pre-armed state such that the voltage storage component is not able to detonate the detonator. The first switching mechanism (e.g., the first relay 130 of FIG. 1) and the second switching mechanism (e.g., the second relay of FIG. 1) may be configured such that the voltage storage component and the detonator are electrically isolated. For example, the first switching mechanism may form an open circuit between the voltage storage component and the rest of the detonator circuitry and the second switching mechanism may form a low-impedance shunt path to ground in parallel with the detonator that diverts current from the detonator.

At step 220, the detonator device or system may be armed. In some embodiments, the detonator device or system may receive an arming instruction from a control device. In some embodiments, the detonator device or system may be armed automatically, e.g., after a particular amount of time has elapsed, the delivery device has traversed a particular distance, or the delivery device has reached a particular location. Arming the detonator device or system may include connecting the voltage storage component to a voltage source to charge the voltage storage component. The voltage storage component may store a voltage that is needed to detonate a low-voltage detonator. In some embodiments, the detonator device or system may perform a safety check prior to arming. The safety check may include, for example, determining a voltage or current across one or more components in the detonator device or system. The voltage storage component and the detonator may remain electrically isolated when the detonator device or system is armed so that the voltage stored in the voltage storage component is not applied to the detonator. Any stray voltage in the detonator device or system that could be sufficient to detonate a low-voltage detonator is diverted from the detonator by the parallel low-impedance shunt path. The detonator device or system is therefore safe from accidental detonation in the armed state.

At step 230, the detonator device or system may be detonated. In some embodiments, the detonator device or system may receive detonation instruction from a control device. In some embodiments, the detonator device or system may detonate automatically, e.g., after a particular amount of time has elapsed, the delivery device has traversed a particular distance, or the delivery device has reached a particular location. The detonation includes electrically connecting the voltage storage component and the detonator. For example, the second switching mechanism may form an open circuit so that the detonator is the only path to ground in the detonator circuitry, and the first switching mechanism may form a closed electrical connection between the voltage storage component and the rest of the detonator circuitry. The voltage stored in the voltage storage component can then be delivered to the detonator to initiate detonation. The detonation of the detonator may cause a chain reaction that results in the detonation of a larger explosive payload coupled to the detonator.

Figure 3:
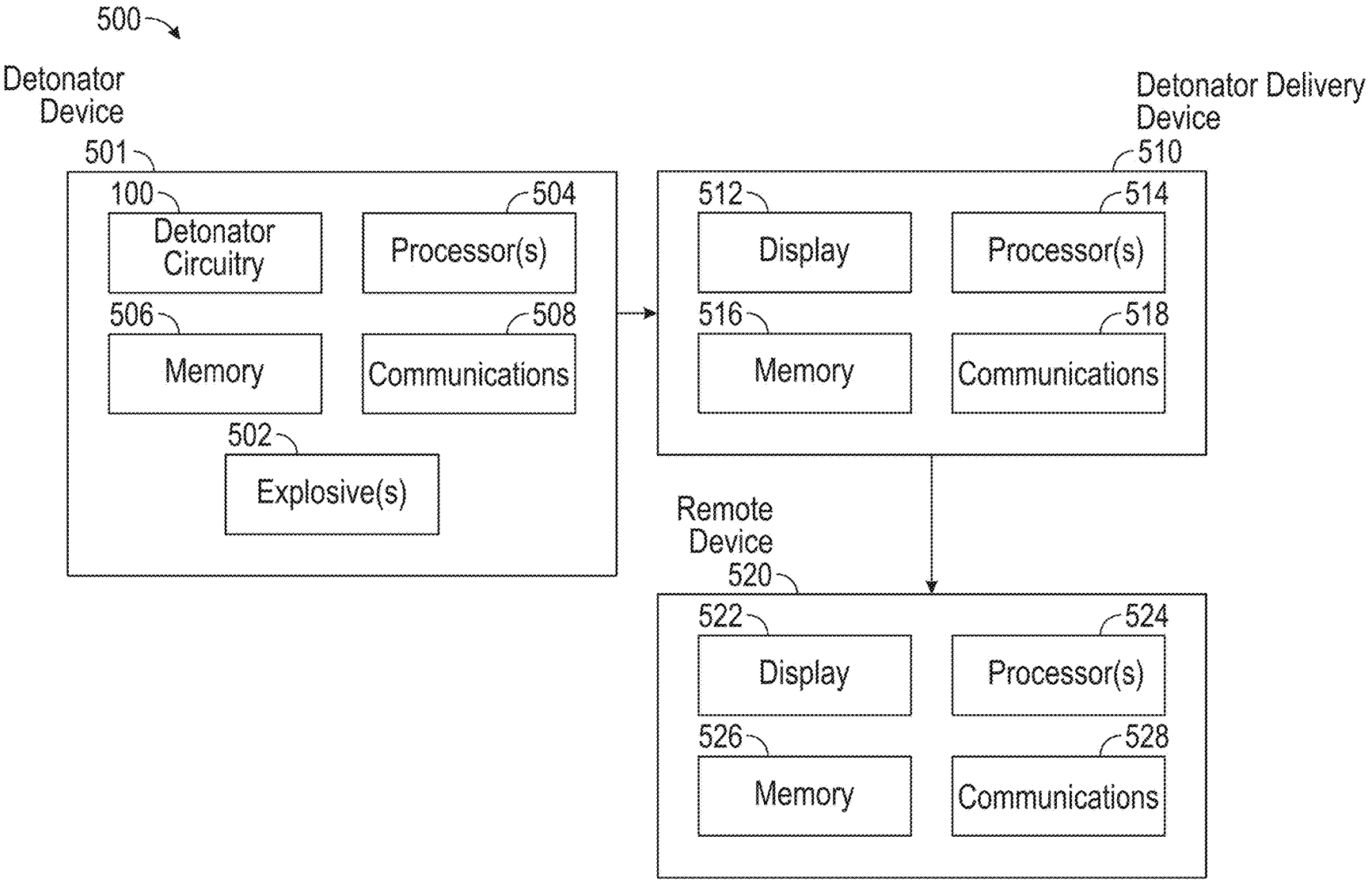
FIG. 3 illustrates a system for arming and detonating a detonator device or system according to some embodiments.

FIG. 3 is an exemplary system 500 for arming and detonation including a detonator device 501, a detonator delivery device 510, and a remote device 520. The detonator device 501 may be mounted to the detonator delivery device 510. The detonator device 501 may include the detonator circuitry 100 described here including the low-voltage detonator, one or more additional explosives 502, one or more processors 504, and a memory 506. The memory 506 may store one or more programs. The one or more processors 504 may be configured to execute the one or more programs. The memory 506 and the one or more processors 504 may be configured to perform one or more aspects of the method disclosed herein, such as arming and detonating the low-voltage detonator. The detonator device 501 may include a communications unit 508. The communications unit 508 may be configured to transmit data to the detonator delivery device 510 (e.g., for local processing using additional compute resources) and/or the remote device 520.

The detonator delivery device 510 may be connected to the detonator device 501 using one or more wired or wireless electronic communication protocols, such as WiFi and/or Bluetooth. The detonator delivery device 510 may include an aerial vehicle (e.g., an unmanned aerial vehicle), a ground vehicle (e.g., an unmanned ground vehicle), an underwater vehicle (e.g., an unmanned underwater vehicle), a surface vehicle (e.g., an unmanned surface vehicle), a missile, etc. In some embodiments, the detonator delivery device 510 may be up to 25 feet in length, up to 50 feet in length, up to 100 feet in length, or greater than 100 feet in length. An unmanned detonator delivery device may be smaller than manned combat vehicles (e.g., tanks, planes) and may be configured for smaller payloads than manned combat vehicles. Thus, it may be advantageous for a detonator device or system to have a smaller footprint. In some embodiments, the detonator device or system may weigh up to 2 pounds, up to 5 pounds, up to 8 pounds, up to 10 pounds, or greater than 10 pounds. In some embodiments, the volume occupied by the detonator device or system may be up to 2 cubic inches, up to 5 cubic inches, up to 10 cubic inches, up to 15 cubic inches, up to 20 cubic inches, up to 25 cubic inches, up to 30 cubic inches, up to 35 cubic inches, or greater than 35 cubic inches.

The detonator delivery device 510 may include a memory 516, one or more processors 514, a display 512, and/or a communications unit 518 (e.g., for receiving data from and transmitting data to detonator device 501 and/or the remote device 520). The memory 516 may store one or more programs. The one or more processors 514 may be configured to execute the one or more programs. The memory 516 and the one or more processors 514 may be configured to perform one or more aspects of the method disclosed herein, such as arming and detonating the low-voltage detonator. The detonator delivery device 510 may transmit instructions to the detonator device 501, e.g., an instruction to arm or detonate the detonator device 501. The detonator delivery device 510 may receive and/or process sensor data from the detonator device 501.

The remote device 520 may be connected to the detonator delivery device 510 using one or more wired or wireless electronic communication protocols. The remote device 520 may include a memory 526, one or more processors 524, a display 522, and/or a communications unit 528 (e.g., for receiving data from and transmitting data to the detonator delivery device 510). The memory 526 may store one or more programs. The one or more processors 524 may be configured to execute the one or more programs. The memory 526 and the one or more processors 524 may be configured to perform one or more aspects of the method disclosed herein, such as arming and detonating the detonator. The remote device 520 may be configured to control the detonator delivery device 510. In some embodiments, the remote device 520 may transmit instructions to the detonator delivery device 510, e.g., an instruction to arm or detonate the detonator device 501. The remote device 520 may receive and/or process sensor data from the detonator device 501. In some examples the system of FIG. 3 may utilize processing capabilities of a plurality of different devices to perform any of the methods disclosed herein.

Certain aspects of the present disclosure include process steps and instructions described herein in the form of an algorithm. It should be noted that the process steps and instructions of the present disclosure could be embodied in software, firmware, or hardware and, when embodied in software, could be downloaded to reside on and be operated from different platforms used by a variety of operating systems. Unless specifically stated otherwise as apparent from the following discussion, it is appreciated that, throughout the description, discussions utilizing terms such as "processing," "computing," "calculating," "determining," "displaying," "generating" or the like, refer to the action and processes of a computer system, or similar electronic computing device, that manipulates and transforms data represented as physical (electronic) quantities within the computer system memories or registers or other such information storage, transmission, or display devices.

The present disclosure in some embodiments also relates to a device for performing the operations herein. This device may be specially constructed for the required purposes, or it may comprise a general-purpose computer selectively activated or reconfigured by a computer program stored in the computer. Such a computer program may be stored in a non-transitory, computer readable storage medium, such as, but not limited to, any type of disk, including floppy disks, USB flash drives, external hard drives, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each connected to a computer system bus. Furthermore, the computing systems referred to in the specification may include a single processor or may be architectures employing multiple processor designs, such as for performing different functions or for increased computing capability. Suitable processors include central processing units (CPUs), graphical processing units (GPUs), field programmable gate arrays (FPGAs), and ASICs.

The methods, devices, and systems described herein are not inherently related to any particular computer or other apparatus. Various general-purpose systems may also be used with programs in accordance with the teachings herein, or it may prove convenient to construct a more specialized apparatus to perform the required method steps. The structure for a variety of these systems will appear from the description below. In addition, the present invention is not described with reference to any particular programming language. It will be appreciated that a variety of programming languages may be used to implement the teachings of the present disclosure as described herein.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A detonator device, comprising:

a voltage storage component;

a first relay connected in series to an output of the voltage storage component;

detonation circuitry connected in series to an output of the first relay, the detonation circuitry comprising a detonator and a second relay connected in parallel to the detonator;

one or more processors and memory storing one or more programs, the one or more programs configured to be executed by the one or more processors; and voltage sensing circuitry configured to determine a relay voltage at an output of the first relay or the second relay and transmit the relay voltage to the one or more processors, wherein the output from the first relay is directed to ground via the second relay when the detonator device is in a first state, the output from the first relay is delivered to the detonator when the detonator device is in a second state, the detonator is configured to detonate when the output from the first relay is applied to the detonator in the second state, the output from the first relay is between 5 and 100 volts, and the one or more programs include instructions that when executed cause the one or more processors to transmit an electronic control signal to the first relay or the second relay based on the relay voltage.

2. The detonator device of claim 1, wherein the output from the first relay is approximately 12 volts.

3. The detonator device of claim 1, wherein the first relay is open and the second relay is closed when the detonator device is in the first state.

4. The detonator device of claim 1, wherein the first relay is closed and the second relay is open in the second state.

5. The detonator device of claim 1, wherein the first relay and/or the second relay comprises an electromechanical relay.

6. The detonator device of claim 1, wherein the first relay and/or the second relay comprises a solid state relay.

7. The detonator device of claim 1, wherein the first relay is a naturally open relay and the second relay is a naturally closed relay.

8. The detonator device of claim 1, wherein the first relay is configured to switch between an open state and a closed state based on an electronic control signal.

9. The detonator device of claim 1, wherein the second relay is configured to switch between a closed state and an open state based on an electronic control signal.

10. The detonator device of claim 1, wherein the first relay and the second relay are configured to switch between respective states based on a shared electronic control signal.

11. The detonator device of claim 1, wherein the one or more programs include instructions that when executed cause the one or more processors to transmit a state change electronic control signal to the first relay to change a state of the first relay.

12. The detonator device of claim 1, wherein the one or more programs include instructions that when executed cause the one or more processors to transmit a state change electronic control signal to the second relay to change a state of the second relay.

13. The detonator device of claim 1, further comprising an explosive coupled to the detonator.

14. A method of arming a detonator device, the method comprising:

storing the detonator device in a pre-armed state, wherein the detonator device comprises a voltage storage component that is uncharged in the pre-armed state and a detonator; and arming the detonator device by charging the voltage storage component to a voltage sufficient to detonate the detonator, wherein an output of the voltage storage component is connected in series to a first relay, an output of the first relay is connected to a parallel combination of the detonator and a second relay, the output of the voltage storage component is directed to ground via the second relay when the detonator device is in the pre-armed state and when the detonator device is armed, the voltage sufficient to detonate the detonator is between 5 and 100 volts, the output of the first relay is connected to voltage sensing circuitry configured to determine a relay voltage at the output of the first relay and transmit the relay voltage to one or more processors, and the detonator device further comprises memory storing one or more programs including instructions that, when executed by the one or more processors, cause the one or more processors to transmit an electronic control signal to the first relay based on the relay voltage.

15. The method of claim 14, further comprising:

detonating the detonator device by opening the second relay and closing the first relay such that the output of the first relay is delivered to the detonator.

* * * * *